US006203111B1

(12) United States Patent
Ollis et al.

(10) Patent No.: US 6,203,111 B1
(45) Date of Patent: Mar. 20, 2001

(54) MINER GUIDANCE USING LASER AND IMAGE ANALYSIS

(76) Inventors: Mark Ollis, 6943 Penn Ave., Pittsburgh, PA (US) 15208; Steven John Scheding, Apt. 7, 2-6 Martin Pl., Mortdale, NSW, 2223 (AU); Christopher C. Fromme, 318 Ophelia St., Pittsburgh, PA (US) 15213; Jorgen Pederson, 10 40th St., Pittsburgh, PA (US) 15201; John Bares, 390 Highview Rd., Wexford, PA (US) 15090; Herman Herman, 810 Greenfield Ave., Pittsburgh, PA (US) 15217; Anthony J. Stentz, 50 Standish Blvd., Pittsburgh, PA (US) 15228; David K. Herdle, 7306 Franklin Rd.; Frank Higgins, 127 Aberdeen Dr., both of Cranberry Twp., PA (US) 16066; Bryan G. Campbell, 318 Wildflower Ct., Pittsburgh, PA (US) 15202

( * ) Notice: Subject to any disclaimer, the term of this patent is extended or adjusted under 35 U.S.C. 154(b) by 0 days.

(21) Appl. No.: 09/430,567

(22) Filed: Oct. 29, 1999

(51) Int. Cl.[7] ..... E21C 35/08

(52) U.S. Cl. ..... 299/1.05; 356/139.03; 701/50; 299/1.4

(58) Field of Search ..... 299/1.05; 405/143; 701/50; 356/153, 139.03, 141.3, 152.2

(56) References Cited

U.S. PATENT DOCUMENTS

| | | | | |
|---|---|---|---|---|
| 3,560,753 | * | 2/1971 | Beug | 299/1.05 |
| 4,047,763 | | 9/1977 | Gilliland et al. . | |
| 4,392,744 | * | 7/1983 | Tatsuhama et al. | 299/1.05 |
| 4,557,524 | | 12/1985 | Melhuish . | |
| 4,715,657 | | 12/1987 | Sato et al. . | |
| 4,856,384 | | 8/1989 | Wechner . | |
| 4,932,481 | | 6/1990 | Wechner . | |
| 5,501,548 | * | 3/1996 | Hayashi et al. | 299/1.4 |
| 5,529,437 | * | 6/1996 | Filipowski et al. | 405/143 |

* cited by examiner

*Primary Examiner*—Eileen D. Lillis
*Assistant Examiner*—John Kreck
(74) *Attorney, Agent, or Firm*—David R. Price

(57) ABSTRACT

A mining machine comprising a vehicle body having forward and rearward ends, the vehicle body being movable along a mine floor, a cutter head mounted on the forward end of the vehicle body, and a position sensing and control apparatus including first and second generally vertical, generally parallel surfaces on the vehicle body, an off-board light source emitting a light beam that strikes the surfaces, an imaging device for imaging both of the plates in a single image, and a computer receiving the single image from the camera, the computer using the single image to determine at least one of the roll, yaw and lateral offset of the machine.

27 Claims, 1 Drawing Sheet

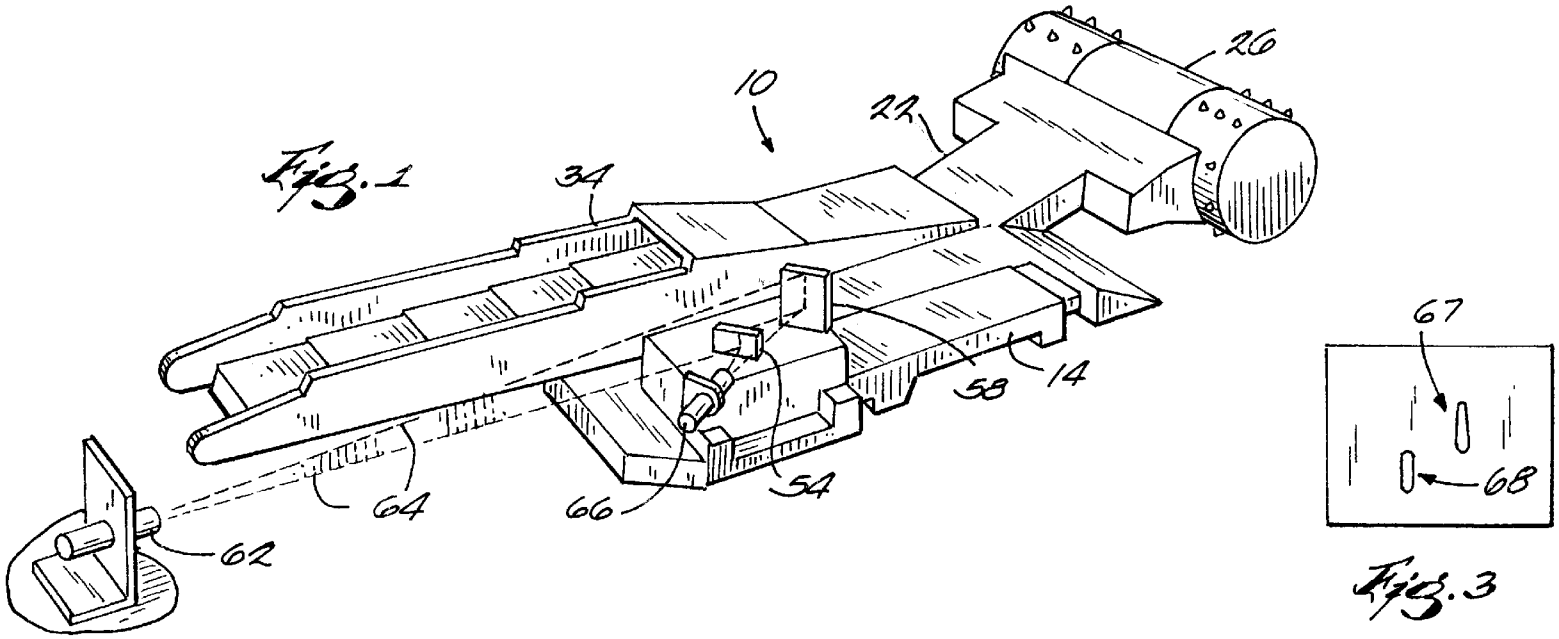
Fig. 1
Fig. 3
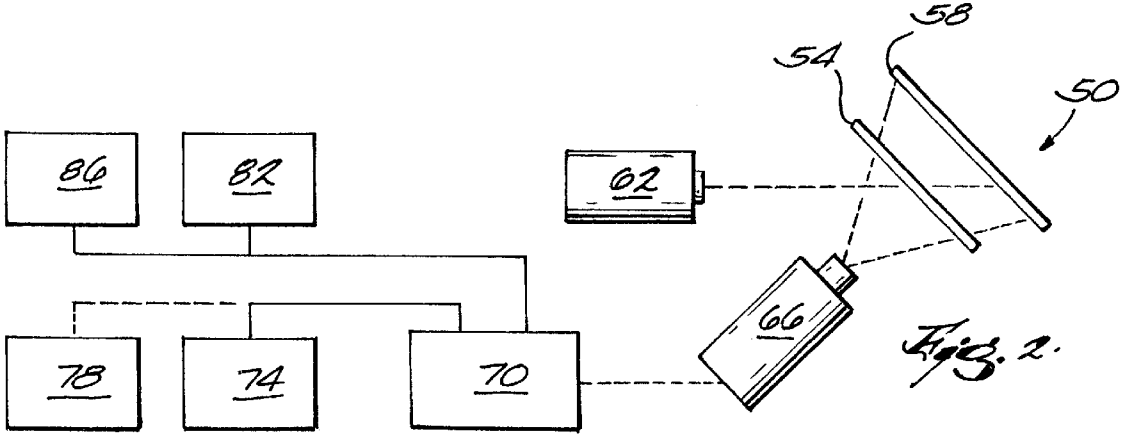
Fig. 2

MINER GUIDANCE USING LASER AND IMAGE ANALYSIS

BACKGROUND OF THE INVENTION

The invention relates to mining machines. More particularly, the invention relates to continuous mining machines, and to methods and apparatus for controlling such machines.

It is known to use a laser to control mining machinery. See, for example, Anderson, D. L., "Framework for Autonomous Navigation of a Continuous Mining Machine: Face Navigation,"(USBM IC 9214, 1989), which describes a laser-based heading control system built by the U.S. Bureau of Mines. This system uses substantial infrastructure, and the method of extracting heading is quite different from the system described below.

There are also multiple examples of guidance and mapping of underground mining vehicles using inertial sensors and scanning laser range finders. See, for example, Makela, H. et al., "Navigation System for LHD machines," Intelligent Autonomous Vehicles, 1995; Scheding, S. et al., "Experiments in autonomous underground guidance," Proceedings of 1997 ICRA, 1995; Shaffer, Gary, "Two dimensional Mapping of expansive unknown areas," PhD. Thesis, Carnegie-Mellon University, 1995.

SUMMARY OF THE INVENTION

The invention provides a mining machine comprising a vehicle body having forward and rearward ends, a cutter head mounted on the forward end for upward and downward movement relative to the vehicle body, and a conveyor mounted on the vehicle body for conveying material cut by the cutter head toward the rearward end. The machine also comprises a position sensing and control apparatus. The apparatus includes first and second generally vertical, generally parallel surfaces on the vehicle body, and an off-board light source emitting a light beam that strikes the surfaces. The apparatus also includes an imaging device for imaging both of the plates in a single image, and a computer receiving the single image from the camera, the computer using the single image to determine at least one of the roll, yaw and lateral offset of the machine.

In the preferred embodiment of the invention, the apparatus includes first and second generally vertical, generally parallel steel plates mounted on the vehicle body, and off-board laser emitting a beam in a generally vertical plane such that the beam strikes the plates. The apparatus also includes a camera mounted on the vehicle body, the camera having a filter so that the camera picks up only light having the wavelength of the laser, and the camera imaging both of the plates in a single image. The apparatus further includes a computer having a framegrabber and receiving the single image from the camera. The computer uses a Hough transform and thresholding to identify those pixels in the image that are illuminated by the laser, uses the identified pixels to calculate a least-squares estimate of the plane containing the laser beam in the reference frame of the camera, transforms the estimated plane into the coordinate plane of the machine, and computes roll, yaw and lateral offset of the camera from the estimated plane.

In the preferred embodiment of the invention, the position sensing and control apparatus also includes a gyroscope and/or an inclinometer used for temporary guidance if the laser is blocked.

In one embodiment of the invention, the mining machine further comprises a controller for steering the vehicle body using PID control, and the computer transmits the roll, yaw and lateral offset to the controller.

In another embodiment of the invention, the mining machine further comprises an operator display, and the computer transmits the roll, yaw and lateral offset to the operator display.

Other features and advantages of the invention will become apparent to those skilled in the art upon review of the following detailed description, claims, and drawings.

DESCRIPTION OF THE DRAWINGS

FIG. 1 is an perspective view of a continuous mining machine embodying the invention.

FIG. 2 is a schematic view of the camera, laser, plates and computer of the machine.

FIG. 3 is a representation of the camera image showing the pixels on the plates illuminated by the laser.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order.

DESCRIPTION OF THE PREFERRED EMBODIMENT

A continuous mining machine 10 embodying the invention is illustrated in FIG. 1. The machine 10 comprises a vehicle body 14 having forward and rearward ends. The vehicle body 14 is supported by crawlers or treads (not shown) for movement along a mine floor (not shown). The machine 10 also comprises a boom 22 extending from the forward end of the vehicle body, and a cutter head 26 mounted on the boom for upward and downward movement for cutting a mine face. The machine 10 also comprises a conveyor 34 mounted on the vehicle body for conveying material cut by the cutter head toward the rearward end of the machine 10. The machine 10 as thus far described is conventional, as would be understood by one skilled in the art.

The machine 10 also comprises a position sensing and control apparatus 50 including first and second generally vertical, generally parallel steel plates 54 and 58, respectively, mounted on the vehicle body 14. FIG. 2 is a schematic view of the control apparatus 50, comprising a laser 62, an imaging device 66, the plates 54 and 58, and a computer 70. The laser 62 is preferably off-board, and emits a beam of energy 64 in a generally vertical plane such that the beam strikes the plates 54 and 58. The imaging device 66, such as a camera, is mounted on the vehicle body 14 and captures an image of the laser beam 64 striking the plates 54 and 58. The camera 66 preferably has a filter, so that the camera 66 picks up only light having the wavelength of the laser beam 64, and Filters out any extraneous light that may be in the mine.

The camera 66 captures the image of both of the plates 54 and 58 in a single image, which is represented in FIG. 3, in which the illuminated portion of plate 58 is indicated by reference numeral 67, and the illuminated portion of plate 54 is indicated by reference numeral 68. The single image is then transferred, or downloaded, to a computer 70. The computer 70 has a framegrabber (not shown) to receive the single image from the camera 66. The computer 70 uses a detection algorithm and thresholding to identify those pixels in the image that are illuminated by the laser beam 64. In a preferred embodiment, the computer 70 uses a Hough transform (as is well understood by those skilled in the art) to determine the illuminated pixels, although it is contemplated that other estimating techniques may be employed. The computer 70 then uses the identified pixels to calculate an estimate of the plane containing the laser beam in the reference frame of the camera. In a preferred embodiment, the computer 70 uses a least squares estimate, although it is contemplated that other estimating techniques may be employed. The computer then transforms the estimated plane into the coordinate plane of the machine, and computes parameters such as roll, yaw and lateral offset of the camera 66 from the estimated plane.

In the illustrated embodiment of the invention, the mining machine further comprises a controller 74 for steering the vehicle body 14 using PID control (as is well understood by those skilled in the art), and the computer transmits the roll, yaw and lateral offset to the controller.

In another embodiment of the invention (shown in phantom in FIG. 2), the mining machine further comprises an operator display 78, and the computer 70 transmits the roll, yaw and lateral offset to the operator display.

Preferably, the position sensing and control apparatus 50 also includes a gyroscope 82 and an inclinometer 86, both of which transmit positional information to the computer 70. This information is used by the computer 70 for temporary guidance of the mining machine 10 in the event the laser 62 is blocked. The use of gyroscopes and inclinometers for guiding mining machines is known in the art.

Various features of the invention are set forth in the following claims.

What is claimed is:

1. A mining machine comprising a vehicle body having forward and rearward ends, said vehicle body being movable along a mine floor, a cutter head mounted on said forward end of said vehicle body, and a position sensing and control apparatus including first and second generally vertical, generally parallel opaque surfaces on said vehicle body, an off-board light source emitting a light beam that strikes said surfaces, an imaging device for imaging both of said plates in a single image, and a computer receiving the single image from said camera, said computer using the single image to determine at least one of the roll, yaw and lateral offset of said machine.

2. A mining machine as set forth in claim 1 wherein said first and second surfaces are respectively provided by generally vertical, generally parallel plates mounted on said vehicle body.

3. A mining machine as set forth in claim 1 wherein said light source is a laser emitting a beam in a generally vertical plane such that said beam strikes said plates.

4. A mining machine as set forth in claim 1 wherein said imaging device is mounted on said vehicle body.

5. A mining machine as set forth in claim 1 wherein said imaging device is a camera.

6. A mining machine as set forth in claim 5 wherein said camera has a filter so that said camera picks up only light having the wavelength of said light source.

7. A mining machine as set forth in claim 5 wherein said computer has a framegrabber.

8. A mining machine as set forth in claim 1 wherein said computer uses a Hough transform and thresholding to identify those pixels in the image that are illuminated by said laser, uses the identified pixels to calculate a least-squares estimate of the plane containing the laser beam in the reference frame of said camera, and transforms said estimated plane into the coordinate plane of said machine.

9. A mining machine as set forth in claim 8 wherein said computer determines the roll, yaw and lateral offset of said camera from said estimated plane.

10. A mining machine as set forth in claim 9 and further comprising a controller for steering said vehicle body using PID control, and wherein said computer transmits said roll, yaw and lateral offset to said controller.

11. A mining machine as set forth in claim 9 and further comprising an operator display, and wherein said computer transmits said roll, yaw and lateral offset to said operator display.

12. A mining machine as set forth in claim 1 wherein said cutter head is movable upward and downward relative to said vehicle body.

13. A mining machine as set forth in claim 1 and further comprising a conveyor mounted on said vehicle body for conveying material cut by said cutter head toward said rearward end.

14. A mining machine as set forth in claim 1 wherein said position sensing and control apparatus also includes at least one of a gyroscope and an inclinometer sending information to said computer for temporary guidance of said machine in the event said light source is blocked.

15. A method of controlling a mining machine comprising a vehicle body having forward and rearward ends, said vehicle body being movable along a mine floor, and a cutter head mounted on said forward end of said vehicle body, said method comprising the steps of:

(a) providing first and second generally vertical, generally parallel opaque surfaces on said vehicle body;

(b) emitting a light beam that strikes said surfaces;

(c) imaging both of said plates in a single image; and (d) using the single image to determine at least one of the roll, yaw and lateral offset of said machine.

16. A method as set forth in claim 15 wherein step (a) includes mounting first and second generally vertical, generally parallel plates on said vehicle body.

17. A method as set forth in claim 15 wherein step (b) includes emitting the beam of light in a generally vertical plane.

18. A method as set forth in claim 15 wherein step (d) includes using a Hough transform and thresholding to identify those pixels in the image that are illuminated by said beam of light, using the identified pixels to calculate a least-squares estimate of the plane containing the beam in the reference frame of said imaging device, transforming said estimated plane into the coordinate plane of said machine, and computing roll, yaw and lateral offset of said imaging device from said estimated plane.

19. A method as set forth in claim 18 wherein the machine also has a controller for steering said vehicle body using PID control, and wherein said method further comprises the step of transmitting said roll, yaw and lateral offset to said controller.

20. A method as set forth in claim 18 wherein the machine also has an operator display, and wherein said method further comprises the step of transmitting said roll, yaw and lateral offset to said operator display.

21. A mining machine comprising a vehicle body having forward and rearward ends, said vehicle body being movable along a mine floor, a cutter head mounted on said forward end for upward and downward movement relative to said vehicle body, a conveyor mounted on said vehicle body for conveying material cut by said cutter head toward said rearward end, and a position sensing and control apparatus including first and second generally vertical, generally parallel steel plates mounted on said vehicle body, an off-board laser emitting a beam in a generally vertical plane such that said beam strikes said plates, a camera mounted on said vehicle body, said camera having a filter so that said camera picks up only light having the wavelength of said laser, and said camera imaging both of said plates in a single image, and a computer having a framegrabber and receiving the single image from said camera, said computer using a Hough transform and thresholding to identify those pixels in the image that are illuminated by said laser, using the identified pixels to calculate a least-squares estimate of the plane containing the laser beam in the reference frame of said camera, transforming said estimated plane into the coordinate plane of said machine, and computing roll, yaw and lateral offset of said camera from said estimated plane.

22. A mining machine as set forth in claim 21 and further comprising a controller for steering said vehicle body using PID control, and wherein said computer transmits said roll, yaw and lateral offset to said controller.

23. A mining machine as set forth in claim 21 and further comprising an operator display, and wherein said computer transmits said roll, yaw and lateral offset to said operator display.

24. A mining machine as set forth in claim 21 wherein said position sensing and control apparatus also includes at least one of a gyroscope and an inclinometer sending information to said computer for temporary guidance of said machine in the event said light source is blocked.

25. A method of controlling a mining machine comprising a vehicle body having forward and rearward ends, said vehicle body being movable along a mine floor, a cutter head mounted on said forward end for upward and downward movement relative to said vehicle body, and a conveyor mounted on said vehicle body for conveying material cut by said cutter head toward said rearward end, said method comprising the steps of:

(a) mounting first and second generally vertical, generally parallel steel plates on said vehicle body;

(b) emitting a beam of light in a generally vertical plane such that said beam strikes said plates;

(c) using an imaging device to image both of said plates in a single image having pixels;

(d) using a Hough transform and thresholding to identify those pixels in the image that are illuminated by said beam of light;

(e) using the identified pixels to calculate a least-squares estimate of the plane containing the beam in the reference frame of said imaging device;

(f) transforming said estimated plane into the coordinate plane of said machine; and (g) computing roll, yaw and lateral offset of said imaging device from said estimated plane.

26. A method as set forth in claim 25 wherein the machine also has a controller for steering said vehicle body using PID control, and wherein said method further comprises the step of transmitting said roll, yaw and lateral offset to said controller.

27. A method as set forth in claim 25 wherein the machine also has an operator display, and wherein said method further comprises the step of transmitting said roll, yaw and lateral offset to said operator display.

* * * * *